United States Patent [19]

Berger et al.

[11] Patent Number: 4,978,815

[45] Date of Patent: Dec. 18, 1990

[54] LOAD SELECTOR FOR STEP TRANSFORMERS

[75] Inventors: Siegbert Berger, Bretten; Karl Kurz, Stuttgart; Alfred Mayer, Lorch, all of Fed. Rep. of Germany

[73] Assignee: Maschinenfabrik Reinhausen GmbH, Regensburg, Fed. Rep. of Germany

[21] Appl. No.: 415,060

[22] Filed: Sep. 29, 1989

[30] Foreign Application Priority Data

Sep. 29, 1988 [DE] Fed. Rep. of Germany ..... 3833126

[51] Int. Cl.[5] ..... H01H 19/54; H01H 33/66

[52] U.S. Cl. ..... 200/11 TC; 200/144 B

[58] Field of Search ..... 200/8 R, 8 A, 10, 11 TC, 200/144 R, 144 A, 144 AP, 144 B

[56] References Cited

U.S. PATENT DOCUMENTS 3,467,800 9/1969 Barr ..... 200/11 TC
3,739,111 6/1973 Wittenzellner et al. ..... 200/11 TC
4,546,222 10/1985 Watanabe et al. ..... 200/144 B

FOREIGN PATENT DOCUMENTS 0151740 8/1985 European Pat. Off. .
2731133 12/1978 Fed. Rep. of Germany .

*Primary Examiner*—J. R. Scott
*Attorney, Agent, or Firm*—Herbert L. Lerner; Laurence A. Greenberg

[57] ABSTRACT

A load selector for switching over from one tap of a step transformer to the next includes fixed step contacts disposed on a circle and connected to taps of a step transformer. At least two switch contacts per phase are disposed in common on a pivotable contact carrier and are simultaneously pivotable on the circle. Two vacuum switches per phase are electrically built into the contact carrier and connected in series with the switch contacts. A cam race is disposed along the circle. Rollers run along the cam race for actuating the vacuum switches. The cam race and the rollers are current free. A slip ring is coaxial with the cam race and the circle. The cam race is disposed axially between and spaced apart from the fixed step contacts and the slip ring. Slip contacts slide on the slip ring. Each of the vacuum switches are eletrically connected between a respective one of the switch contacts and a respective one of the slip contacts.

14 Claims, 4 Drawing Sheets

LOAD SELECTOR FOR STEP TRANSFORMERS

BACKGROUND OF THE INVENTION

1. Field of the Invention:

The invention relates to load selectors for switching over from one tap of a step transformer to the next, including fixed step contacts being connected to the taps and being disposed on a circle, at least two switches per phase being simultaneously pivotable on the circle and disposed on a common contact carrier, two vacuum switch contacts per phase being electrically built into the pivotable contact carrier and connected in series with the switch contacts, and a cam race disposed on the circle for controlling rollers for actuating the vacuum switches contacts.

Load selectors, like step switching devices that have separate load reversers and selectors, serve the purpose of switching over taps of control windings of transformers under load in order to purposefully compensate for consumer voltage changes. Load selectors become less expensive to manufacture and use than the step switching devices predominantly used in the past, by dispensing with the separation of the load reverser from the selector.

2. Description of the Related Art:

Even in the load selector, arcs occur at various contacts in the reversal process, and they not only destroy the transformer oil bathing them but they also contaminate the transformer oil with erosion products of the switch contacts, and therefore impair the electrical strength of the oil. In order to avoid such arcs, German Published, Prosecuted application No. DE-AS 27 31 133 B1 suggests switching the step short-circuit current on and off at vacuum switches. To this end, in the known configuration, one vacuum switch is connected in series with each switch contact roller, and another vacuum switch is also connected in series with a transition resistor per contact carrier. All that is taught by that document about the structure of a load selector of that kind having vacuum switches, is that the vacuum switches are accommodated on the pivotable contact carrier, and that rollers provided for controlling it carry the load current.

Published European application No. 0 151 740 discloses the structural layout of a load selector without vacuum switches. In that construction, three contact rollers per phase are provided. The rollers run on fixed counterpart contacts simultaneously acting as switch cams and they control the movements of parts of the pivotable contact carrier. When pivoting the contact carrier, a step short-circuit current limited by a transition resistor is first switched on, and interrupted again immediately thereafter as the contact carrier pivots onward. The effect of the arcs created between the fixed switch contacts and the contact rollers in such a case is then as discussed initially above.

SUMMARY OF THE INVENTION:

It is accordingly an object of the invention to provide a load selector for step transformers, which overcomes the hereinafore-mentioned disadvantages of the heretofore-known devices of this general type, which has a structural configuration with vacuum switches that can be used economically and is operationally reliable.

With the foregoing and other objects in view there is provided, in accordance with the invention, a load selector for switching over from one tap of a step transformer to the next, comprising fixed step contacts disposed on a circle and connected to taps of a step transformer; a pivotable contact carrier, at least two switches per phase being disposed in common on the contact carrier and simultaneously pivotable on the circle; two vacuum switch contacts per phase electrically built into the contact carrier and connected in series with the switches; a cam race disposed along the circle, rollers running along and being controlled by the cam race for actuating the vacuum switch contacts, the cam race and the rollers being current free; a slip ring coaxial with the cam race and the circle, the cam race being disposed axially between and spaced apart from the fixed step contacts and the slip ring by a pronounced distance; and slip contacts sliding on the slip ring, each of the vacuum switch contacts being electrically connected between a respective one of the switch contacts and a respective one of the slip contacts.

In accordance with another feature of the invention, there is provided a cylinder of insulating material having an inner surface, the fixed step contacts, the cam race or races and the slip ring being disposed on the inner surface of the cylinder.

In accordance with a further feature of the invention, the cam race is a ring of wear-resistant, electrically insulating material.

In accordance with an added feature of the invention, the cam race is a ring formed of a plurality of segments, each of the segments having at least two cams as well as at least one dowel pin and two screws securing each of the segments in the cylinder.

In accordance with an additional feature of the invention, there is provided a contact carrier housing, two sleeves being concentric to one another and to the vacuum switches, the sleeves being built into the contact carrier housing along with the vacuum switches contacts defining cylindrical walls, and compression springs each being guided between the cylindrical walls by the sleeves for opening a respective one of the vacuum switches contacts.

In accordance with yet another feature of the invention, one of the sleeves is an inner sleeve being bottomless as seen towards the insulator and formed of insulating material, the other of the sleeves is an outer sleeve being displaceable in axial direction of the other sleeve and having a bottom with an opening formed therein, and the vacuum switches have a movable contact bolt being guided in the opening.

In accordance with yet a further feature of the invention, the movable contact bolt has a free end, and there is provided a connection piece form-lockingly secured on the free end, the connection piece being carried along with the outer sleeve for opening the vacuum switch counter to atmospheric pressure, upon relaxation of the compression spring.

In accordance with yet an added feature of the invention, there is provided a fork guided in the contact carrier housing, the rollers being carried by the fork.

In accordance with yet an additional feature of the invention, there is provided a cup-shaped pressure piece through which the fork moves the outer sleeve and causes the compression spring to tense and relax.

In accordance with again another feature of the invention, there are provided bearing blocks disposed on the contact carrier housing, a one-armed lever being supported on the bearing blocks, the one-armed lever having an axis of rotation, a side facing toward the vacuum switch and a free end embraced by the fork, the one-armed lever having two protrusions disposed equidistantly from the axis of rotation on the side facing toward the vacuum switch, the protrusions flanking the movable contact bolt and the connection piece and pressing the movable contact bolt and the connection piece against the outer sleeve.

In accordance with again a further feature of the invention, the one-armed lever has a cross section with a U-shaped profile having legs being open toward the vacuum switch, and there are provided two rotatably supported disks being fitted into recesses formed in the legs for bracing the one-armed lever in the fork.

In accordance with again an added feature of the invention, there is provided a compression spring disposed in a concentric bore formed in the movable contact bolt, and an auxiliary bolt compressing the compression spring and being braced on the one-armed lever for assuring emergency operation upon the occurrence of a loss or destruction of vacuum in the vacuum switch. Alternatively, the compression spring disposed in the concentric bore formed in the movable contact bolt may be braced on the cup-shaped pressure piece for the same reason.

In accordance with again an additional feature of the invention, there are provided adjustable stops disposed on the contact carrier housing for limiting maximum motion of the fork in a direction toward the cam race.

In accordance with a concomitant feature of the invention, there is provided at least one other fork, at least one of the forks carrying two of the rollers.

The fork actuates the vacuum switches, either through the cup-like pressure piece or through the one-armed lever supported on the bearing blocks on the contact carrier housing.

The load selector according to the invention is very advantageous, because a simple, sturdy and operationally reliable structure is assured as a result of the separation of the group of components required for mechanical control of the vacuum switches from the group of components for guiding the switch contacts carrying the load current.

Other features which are considered as characteristic for the invention are set forth in the appended claims.

Although the invention is illustrated and described herein as embodied in a load selector for step transformers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 4:
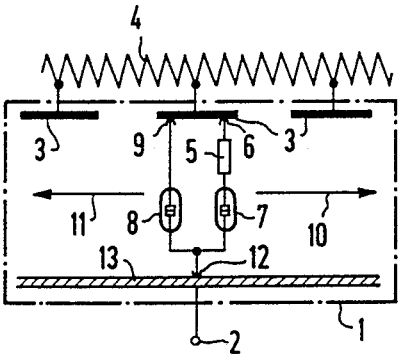
FIG. 4 is a schematic circuit circuit diagram of a load selector in the form of an asymmetrical rotating arm or pennant circuit.

DESCRIPTION OF THE PREFERRED EMBODIMENTS:

Referring now in detail to the figures of the drawing in which elements that are equivalent to one another are identified by the same reference numerals and first, particularly, to FIG. 4 thereof, there is seen a load selector 1 used to change the ratio of a transformer, by electrically or galvanically connecting a mains or network terminal 2 to fixed step contacts 3, which in turn are firmly connected to taps of a step winding 4 of a transformer. During a switchover, a switch contact 6, which is connected in series with a transition resistor 5, is first pivoted to the adjacent step contact 3, in the course of which a vacuum switch 7 opens prior to the lifting of the switch contact 6 from the step contact 3, and closes again only after the switch contact 6 has been applied to the next step contact 3. Within the switchover process, the opening of a vacuum switch 8 that is electrically connected in series with a switch contact 9 takes place, so that the load current commutes to the vacuum switch 7 and the switch contact 6. In this process, the voltage increases when the switching is in the direction of an arrow 10 and decreases when it is in the direction of an arrow 11.

When switching, an attempt is made to keep the time between the closure of the vacuum switch 7 and the ensuing opening of the vacuum switch 8 as brief as possible, because during this time a step of the step winding 4 is electrically short-circuited, and the step short-circuit work during this period must be borne by the transition resistor 5. The size requirement of the transition resistor 5 and of a cooling device thereof accordingly depend very greatly on the length of this period of time. On the other hand, the load current must not be interrupted, regardless of what occurs.

Figure 1:
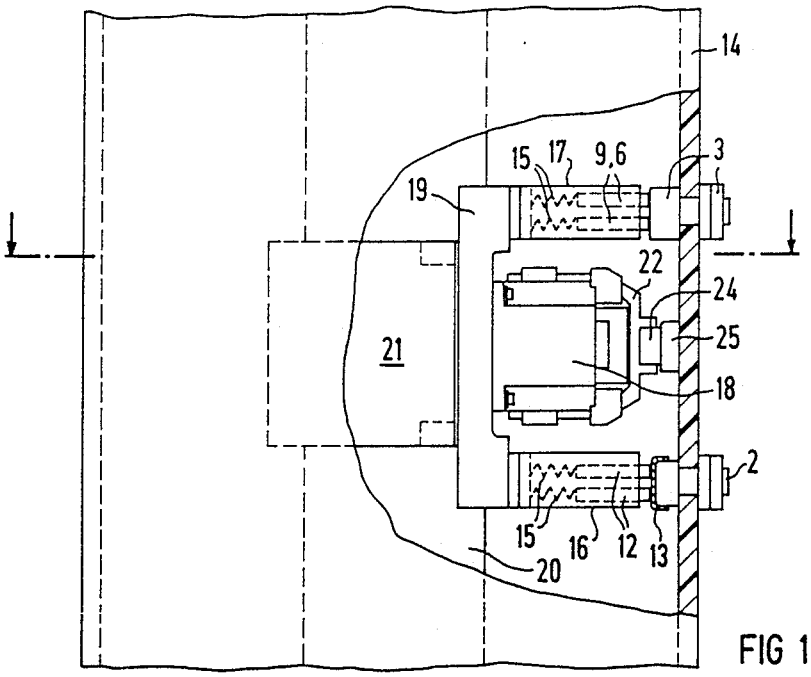
FIG. 1 is a fragmentary, diagrammatic, side-elevational view of a load selector, which is partly broken-away and in section.

In the load selector 1 according to the invention, the load current is diverted from the vacuum switches 7 and 8 to the mains terminal 2 through slip contacts 12 and a slip ring 13. The slip ring 13 is rolled from sheet copper, has a U profile, and is disposed on a support ring 13' on the inside of a cylinder 14 of insulating material seen in FIGS. 1–3. The slip ring 13, support ring 13' and mains terminal 2 are screwed to one another on the insulator cylinder 14.

The slip contacts 12 are displaceable against springs 15 in a guide arm 16. The guide arm 16 along with a corresponding guide arm 17 for the switch contacts 6 and a switch contact carrier 18, has a common base plate 19, which is secured on a switch shaft 20. An incomplete or partial cylinder 21 serves as a support for the transition resistor 5, which is in the form of a wire helix, and is attached to rails 19' that protrude circumferentially from the base plate 19.

Two forks 22 have tines 22' with ends facing one another which carry guide rollers 23 that slide in radial grooves 18' in the switch contact carrier 18 and allow the forks 22 to execute radial movement. Each of the forks 22'' have a cross bar which forms a bearing block for rollers 24 along with webs that protrude radially outward. The rollers 24 run along a cam race 25 on the inside of the insulator cylinder 14, causing the forks 22 to execute radial motions with respect to the switch shaft 20. Each fork 22 has bearings for two rollers 24, but normally only the fork for controlling the vacuum switch 8 that is electrically connected in series with the switch contact 9 in fact has two rollers 24, while in the other fork 22, a roller 24 is installed only on the side facing the adjacent fork 22.

Figure 2:
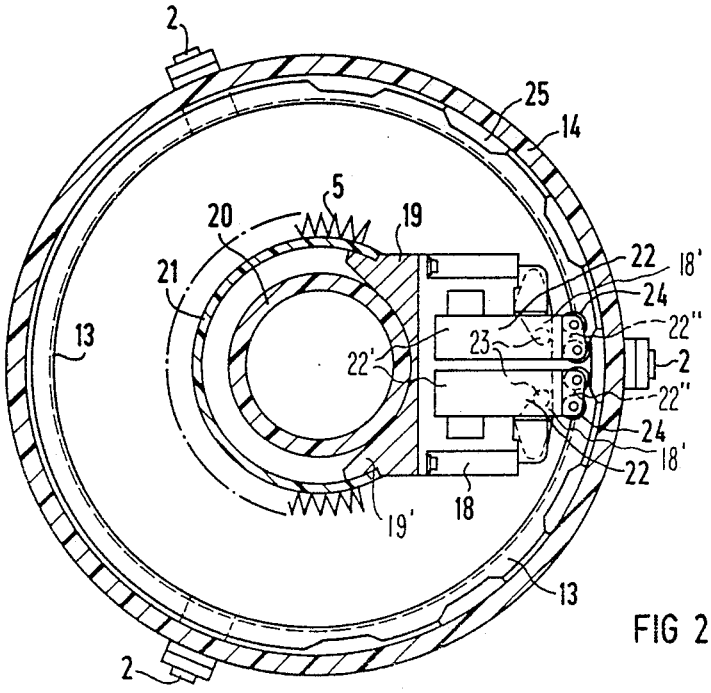
FIGS. 2 and 3 are cross-sectional views of the load selector, on a greatly smaller scale.
Figure 3:
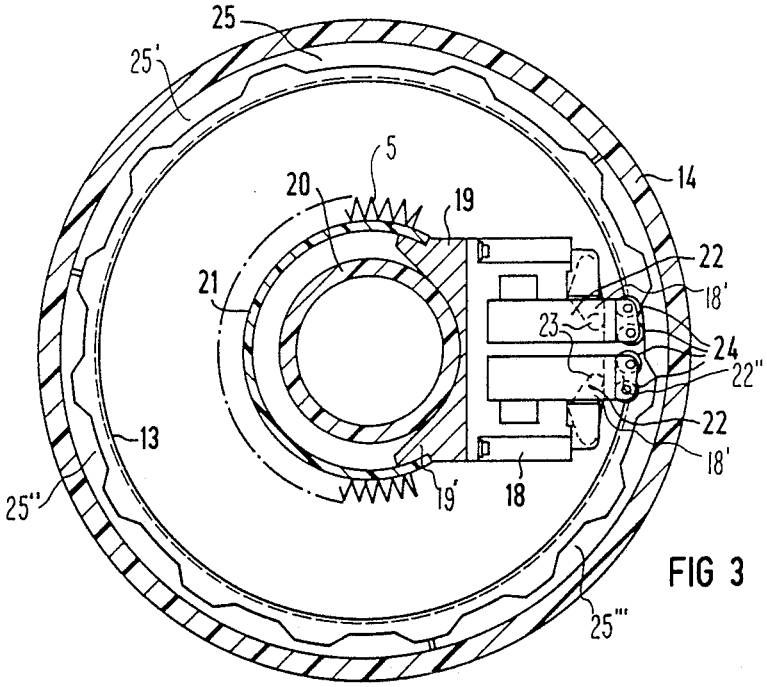

The cam race 25 in the embodiment of FIG. 2 is composed of a great number of parts. In contrast, the cam race 25 in the embodiment of FIG. 3 is composed of only three segments 25', 25'', 25''', each of which is locked in place by a dowel pin and retained by two screws in the insulator cylinder 14, in a non-illustrated manner. In each case, the cam race 25 is formed of wear-resistant, electrically insulating material.

Figure 5:
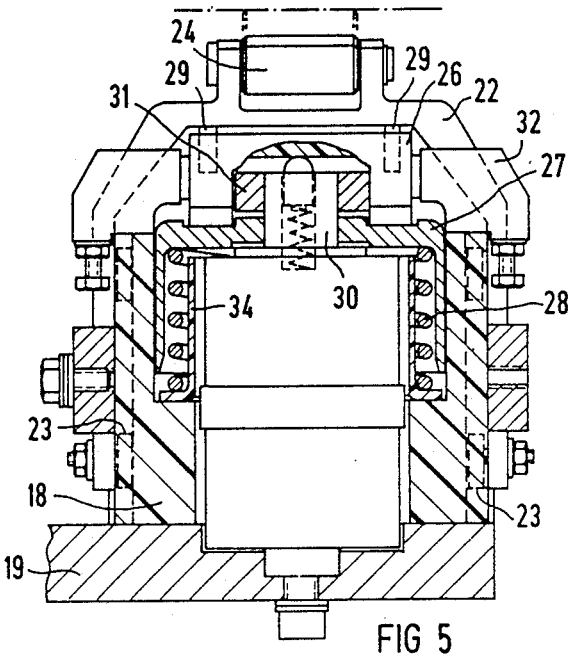
FIGS. 5, 6 and 7 are respective cross-sectional, longitudinal-sectional and plan views of a first embodiment of a pivotable contact carrier having vacuum switches.
Figure 6:
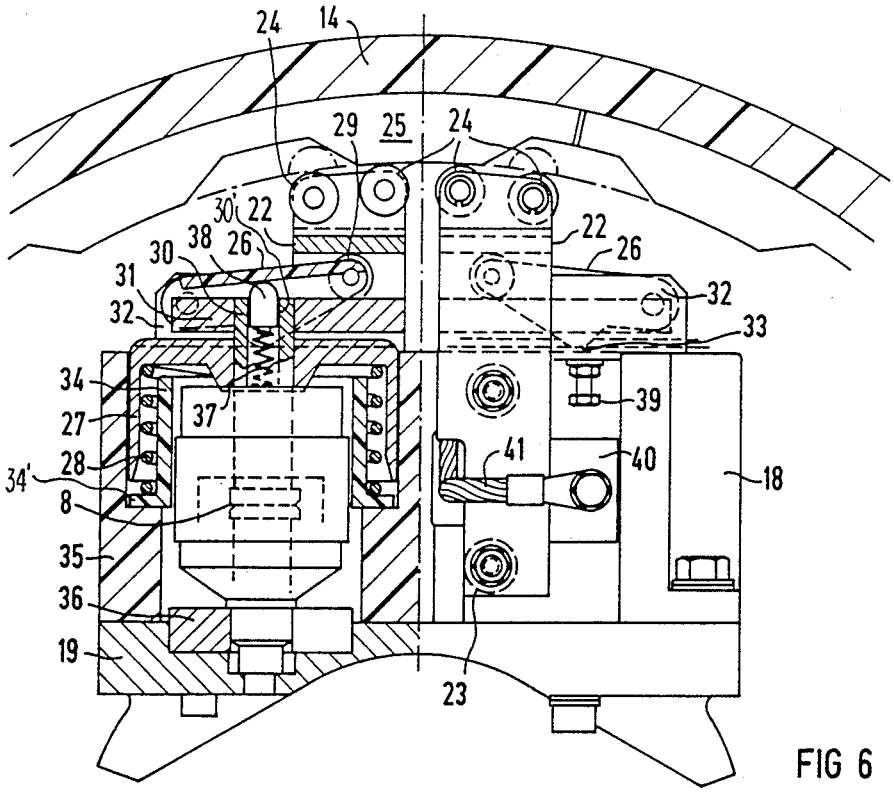
Figure 7:
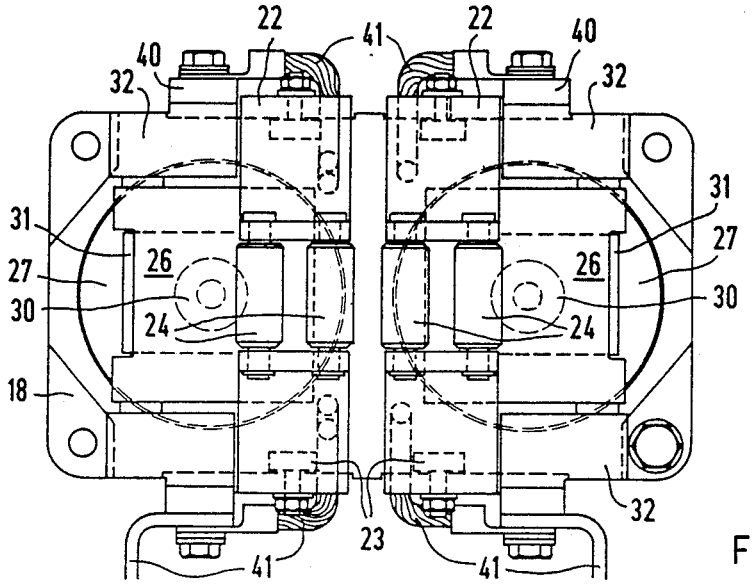

Each of the forks 22 in the embodiment shown in FIGS. 5–7 is braced in the direction toward the switch shaft 20 through a lever 26 and an outer sleeve 27 on a compression spring 28. As seen in cross section, the one-armed lever 26 has a U-shaped profile, which is open toward a vacuum switch 7 or 8 and braced in the fork 22 through two disks 29 that are rotatably supported and fitted into recesses in the legs of the profile of the lever 26. The one-armed lever 26 is made from insulator material and embraces the free end of a movable contact bolt 30 of the vacuum switches 7 or 8 and a connection piece 31 supported by the contact bolt 30 in a force-locking manner. A force-locking connection is one which connects two elements together by force external to the elements, as opposed to a form-locking connection which is provided by the shapes of the elements themselves. The one-armed lever 26 has one protrusion 33 on each respective one of its legs, approximately midway between a bearing point thereof in bearing blocks 32 attached to the housing and a bearing of disks 29, so that a defined engagement point exists between the lever 26 and the outer sleeve 27.

The outside of the compression spring 28 is guided by the outer sleeve 27 and the inside thereof is guided by an inner sleeve 34. The inner sleeve 34 in turn has an encompassing flange 34' on the lower end thereof, which is guided by a switch contact carrier housing 35. The inner sleeve 34 also guides the vacuum switch 7 or 8 that is secured with its fixed contact and contact plates in the base plate 19.

Figure 8:
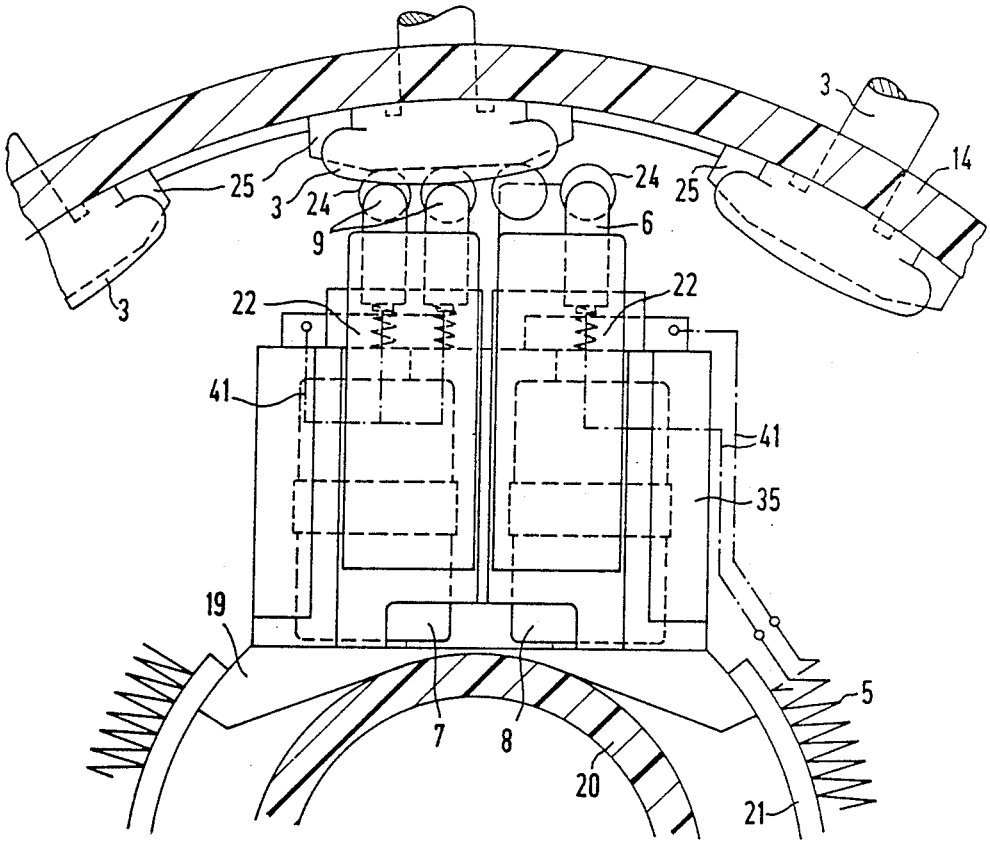
FIGS. 8, 9 and 10 are respective cross-sectional, longitudinal-sectional and plan views of a second embodiment of a pivotable contact carrier for a load selector.
Figure 9:
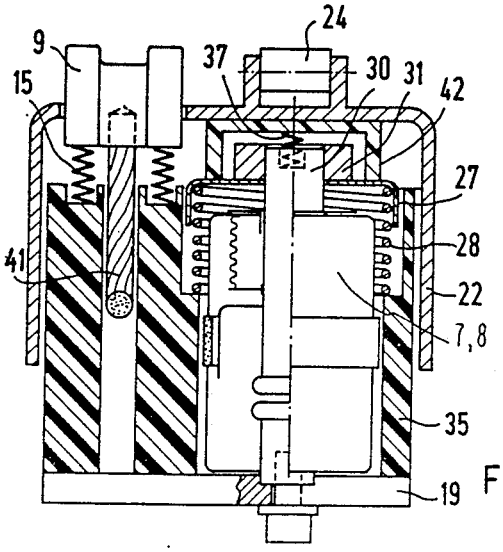
Figure 10:
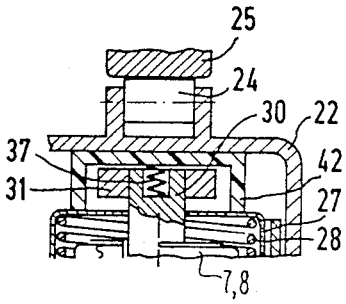

Each movable contact bolt 30 of the vacuum switches 7 and 8 has a concentric bore 30' for receiving a compression spring 37, which presses an auxiliary bolt 38 from below against the lever 26. The maximum outward displacement of the forks 22 in the radial direction between two adjacent cams of the cam race 25 is limited by stop screws 39 connected to the housing, which cooperate with stop blocks 40 on the forks 22. The stop blocks 40 simultaneously serve as fastening points for connection leads 41, which begin at the connection pieces 31. The embodiment of FIGS. 8–10 is slightly simplified by comparison with the embodiment described above and is intended preferably for use with lesser switch capacities. The switch contacts 6 and 9 in this embodiment are jointly built into the contact carrier housing 35 and penetrate the forks 22. However, in this configuration as well, there is a pronounced spatial distance between the current-carrying switch contacts 6 and 9, on one hand, and the rollers 24 which are free of current, on the other. In this simplified form, the lever 26 is replaced with a cup-shaped pressure piece 42, which transmits the radial motions of the forks 22 directly to the outer sleeve 27, and the function of the inner sleeve 34 is performed by the housing of the associated vacuum switch 7 or 8. Since the pressure piece 42 executes no tilting motions at all with respect to the contact bolt 30, in this embodiment the compression spring 37 presses directly against the pressure piece 42, that is with the auxiliary bolt 38 omitted.

Regardless how of the pivotable switch contact carrier 18 is constructed, both forks 22 are pressed radially inward in the rest position, so that the outer sleeve 27 along with the movable end of the compression spring 28 are displaced toward the switch shaft 20, either through the lever 26 or through the pressure piece 42. In this position, the connection piece 31 and therefore the contact bolt 30 of the respective associated vacuum switch 7 or 8 is decoupled from the outer sleeve 27, so that atmospheric pressure closes the vacuum switch 7 or 8.

When pivoting occurs, as soon as the rollers 24 leave a cam of the cam race 25 and the associated fork 22 consequently moves radially outward, the compression spring 28 presses the outer sleeve 27 against the connection piece 31, and lifts the movable contact of the vacuum switch 7 or 8 through the force-locking connection between that element and the contact bolt 30. The fork 22 is then thrust radially inward once again upon meeting the next cam of the cam race 25, and in so doing presses the outer sleeve 27 and the compression spring 28 inward, so that atmospheric pressure once again closes the vacuum switch 7 or 8.

The contact carrier housing 35 and the base plate 19 are constructed in such a way that by simply replacing the sleeves 27 and 34, it becomes possible to use different types of vacuum switches 7 and 8 which are made by various manufacturers and have slightly different dimensions.

We claim:

1. Load selector for switching over from one tap of a step transformer to the next, comprising:

a switch shaft, a pivotable contact carrier on said switch shaft, an insulator disposed along a circle, fixed step contacts disposed on said insulator along said circle and connected to taps of a step transformer;

at least two switch contacts per phase being disposed in common on said contact carrier and simultaneously pivotable on said circle;

two vacuum switches per phase electrically built into said contact carrier and connected in series with said switch contacts;

a cam race disposed on said insulator along said circle, rollers being supported by said contact carrier and running along said cam race for actuating said vacuum switches;

a slip ring being supported on said insulator and being coaxial with said cam race and said circle, said cam race being disposed axially between and spaced apart from said fixed step contacts and said slip ring; and slip contacts being supported by said contact carrier for sliding on said slip ring, each of said vacuum switches being electrically connected between a respective one of said switch contacts and a respective one of said slip contacts.

2. Load selector according to claim 1, wherein said insulator is a cylinder of insulating material having an inner surface, said fixed step contacts, said cam race and said slip ring being disposed on said inner surface of said cylinder.

3. Load selector according to claim 1, wherein said cam race is a ring of wear-resistant, electrically insulating material.

4. Load selector according to claim 1, including a contact carrier housing, two sleeves being concentric to one another and to said vacuum switches, said sleeves being built into said contact carrier housing along with said vacuum switches and said sleeves defining cylindrical walls, and compression springs each being guided between said cylindrical walls by said sleeves for opening a respective one of said vacuum switches.

5. Load selector according to claim 4, wherein one of said sleeves is an inner sleeve being bottomless as seen towards said insulator and formed of insulating material, the other of said sleeves is an outer sleeve being displaceable in axial direction of said other sleeve and having a bottom with an opening formed therein, and said vacuum switches have a movable contact bolt being guided in said opening.

6. Load selector according to claim 5, wherein said movable contact bolt has a free end, and including a connection piece locked on said free end, said connection piece being carried along with said outer sleeve for opening said vacuum switch, upon relaxation of said compression spring.

7. Load selector according to claim 6, including a fork guided in said contact carrier housing, said rollers being carried by said fork.

8. Load selector according to claim 7, including adjustable stops disposed on said contact carrier housing for limiting maximum motion of said fork in a direction toward said cam race.

9. Load selector according to claim 7, including at least one other fork, at least one of said forks carrying two of said rollers.

10. Load selector according to claim 7, including a cup-shaped pressure piece through which said fork moves said outer sleeve and causes said compression spring to tense and relax.

11. Load selector according to claim 10, including a compression spring being disposed in a concentric bore formed in said movable contact bolt and braced on said cup-shaped pressure piece for assuring emergency operation upon the occurrence of a loss of vacuum in said vacuum switch.

12. Load selector according to claim 7, including bearing blocks disposed on said contact carrier housing, a one-armed lever being supported on said bearing blocks, said one-armed lever having an axis of rotation, a side facing toward said vacuum switch and a free end embraced by said fork, said one-armed lever having two protrusions disposed equidistantly from said axis of rotation on said side facing toward the vacuum switch, said protrusions flanking said movable contact bolt and said connection piece and pressing said movable contact bolt and said connection piece against said outer sleeve.

13. Load selector according to claim 12, wherein said one-armed lever has a cross section with a U-shaped profile having legs being open toward said vacuum switch, and including two rotatably supported disks being fitted into recesses formed in said legs for bracing said one-armed lever in said fork.

14. Load selector according to claim 12, including a compression spring disposed in a concentric bore formed in said movable contact bolt, and an auxiliary bolt compressing said compression spring and being braced on said one-armed lever for assuring emergency operation upon the occurrence of a loss of vacuum in said vacuum switch.

* * * * *